United States Patent [19]

Vossen

[11] 4,003,223

[45] Jan. 18, 1977

[54] REPLACEMENT KNITTING MACHINE FEED WHEEL

[76] Inventor: Robert Joseph Vossen, 35 E. Woods Drive, Huntington, N.Y. 11743

[22] Filed: Aug. 11, 1975

[21] Appl. No.: 603,333

[52] U.S. Cl. ..... 66/125 R; 66/132 T; 226/194

[51] Int. Cl.[2] ..... D04B 15/48

[58] Field of Search ..... 66/132 T, 132 R, 125 R; 226/194

[56] References Cited

UNITED STATES PATENTS

| | | | |
|---|---|---|---|
| 3,243,091 | 3/1966 | Rosen | 66/132 T |
| 3,418,831 | 12/1968 | Nance | 66/132 T |
| 3,709,444 | 1/1973 | Tannert | 66/132 T |
| 3,814,300 | 6/1974 | Fukayama | 226/194 |
| 3,854,307 | 12/1974 | Seibold | 66/132 T |
| 3,901,052 | 8/1975 | Jacobsson | 66/125 R |
| 3,907,234 | 9/1975 | Sato | 226/194 X |

OTHER PUBLICATIONS

*Philip Introduces Variable Speed Positive Feed Device* In Knitting Times, 44(11): pp. 50–51, Mar. 17, 1975.

IRO Tape Installation Advertisement acquired at the Apr. 1963 Knitting Arts Show in Atlantic City, New Jersey.

*Primary Examiner*—Mervin Stein
*Assistant Examiner*—A. M. Falik
*Attorney, Agent, or Firm*—Bauer, Amer & King

[57] ABSTRACT

As a replacement for a worn out embodiment of a knitting machine feed wheel, the invention contemplates only a partially complete feed wheel construction which is completed using a bearing salvaged from the worn out wheel, thus saving the expense of two bearings as well as providing other benefits.

2 Claims, 7 Drawing Figures

FIG.3

REPLACEMENT KNITTING MACHINE FEED WHEEL

The present invention relates generally to an improved knitting machine yarn-feeding roller or wheel, the improvements more particularly significantly decreasing the cost of the wheel as a replacement for a worn out embodiment, as well as facilitating maintaining the replacement wheel in good operating order.

As disclosed in the patent literature, as for example in U.S. Pat. No. 3,090,215, an approved technique for feeding yarn from its source to the knitting station of a knitting machine contemplates supporting the yarn on a rotatable feed wheel together with a superposed control feed tape, and urging the tape through movement which provides corresponding feed movement to the yarn and, of course, rotation in the feed wheel. In practice, rubbing contact of the tape against flanges of the feed wheel, or lint from the yarn entangling in the wheel, accumulation of wax and spinning oil from the yarn within the wheel, wearing of the pins due to certain types of synthetic yarn being run, rusting of the pins due to non-use or neglect of the equipment, or such occurrences necessitates replacing the feed wheel.

An important contribution of the present invention is the recognition that the internally housed bearing usually remains, and is, in good operating order, in an otherwise worn out feed wheel which must be replaced, and that a replacement construction or design of said feed wheel can therefore advantageously utilize a salvaged bearing, as well as provide other benefits.

Broadly, it is an object of the present invention to provide a knitting machine replacement feed wheel of significantly reduced cost, and one which further is better adapted to be serviced and maintained in good running order. Specifically, it is an object to provide a feed wheel constructed to be readily fitted with a bearing in a simple assembly procedure; thus, the replacement construction readily accommodates a salvaged bearing and, incident to lint removal or cleaning of the same, the bearing is readily disassembled or removed from the construction to permit this maintenance work on the wheel.

An improved knitting machine feed wheel demonstrating objects and advantages of the present invention is specifically intended to be used for replacing an embodiment thereof worn out from use in feeding yarn from a supply source to a knitting station of a knitting machine, said replacement feed wheel comprising only a partially complete feed wheel construction consisting of a yarn supporting body, preferably in the form of plural circumferentially spaced pins operatively arranged in spanning relation between a cooperating pair of first and second housing members. One said housing member has a centrally located wall bounding a bearing compartment sized to receive in seated relation therein a bearing salvaged from the worn out feed wheel, said salvaged bearing being operatively disposed within said bearing compartment to complete the construction of said replacement feed wheel. Following the seating of the salvaged bearing means are provided to hold the bearing in place during subsequent yarn feeding service of the wheel.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
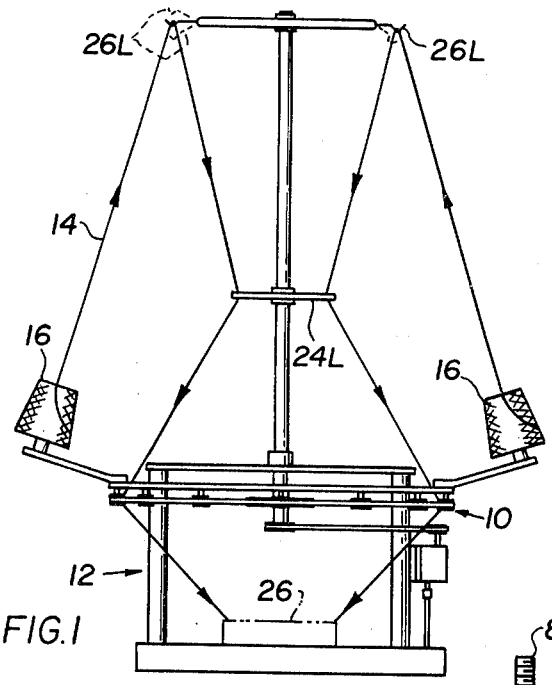
FIG. 1 is a front elevational view of a knitting machine illustrating typical use of a feed wheel for the knitting yarn thereof.
Figure 4:
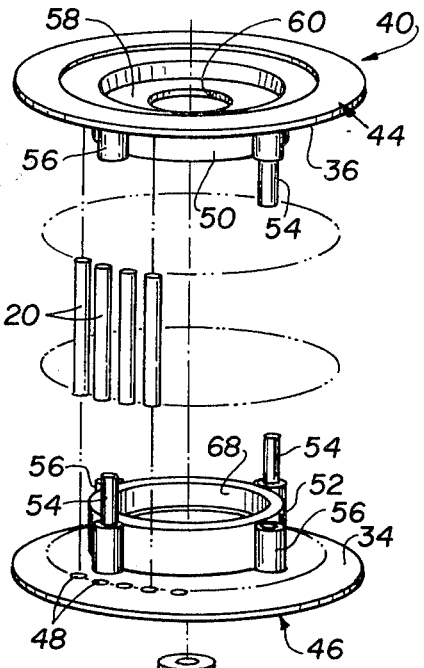
FIG. 4 is a side elevational view of the assembled feed wheel, in transverse cross-section, illustrating further structural details thereof.
Figure 4:
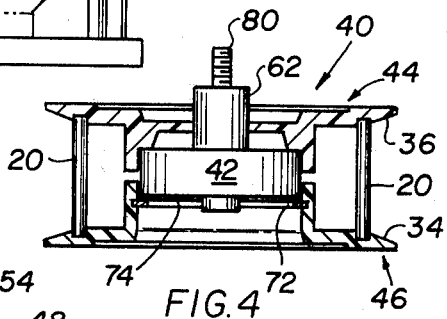
Figure 2:
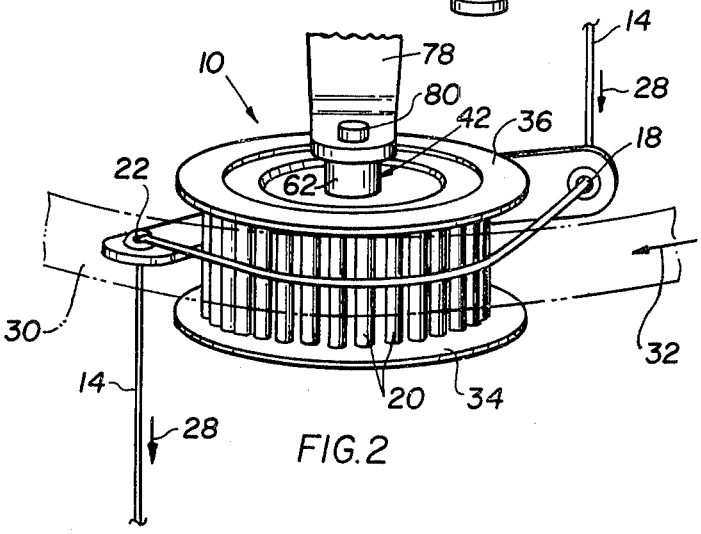
FIG. 2 is a perspective view, on an enlarged scale, of said knitting machine feed wheel.

Reference is not made to the drawings, and in particular to FIGS. 1, 2 which illustrate the manner in which a feed wheel, generally designated 10 (FIG. 2) is used in a circular knitting machine, generally designated 12 (FIG. 1). As background for the within invention, it will be understood that in the operation of the knitting machine 12, yarn 14 is systematically removed from a yarn package or supply spool 16 and arranged in feeding relation to the feed wheel 10. More particularly, as illustrated in FIG. 1, yarn 14 is looped through a top stop-motion device 26L, descends through a threading flange 24L, and then through the entrance eyelet 18, FIG. 2. From the entrance eyelet 18, the yarn is partially wrapped about the circumferentially spaced pins 20, or the wheel 10, and then threaded through an exit eyelet 22 on its way to the knitting station of the machine 12. In this connection, turning again to FIG. 1, the exiting yarn 14 assumes a descending path or orientation terminating at what will be understood to be the knitting station 26 of the machine 12.

To assist in focusing in on the utility of the improved replacement feed wheel 10 of the present invention, attention is again directed to FIG. 2 in connection with which it will be understood that cooperating with the feed wheel 10, and urging the yarn 14 through its feeding movement 28 between the source of supply 16 and the station 26, is a feed tape 30 which engages the partial wrap of the yarn 14 about the wheel 10 such that when the tape 30 is urged through movement 32, it necessarily results in the feed movement 28 of the yarn 14. One of the consequences, however, of the use of the tape 30 is that it ultimately results in excessive wear in either the upper or lower flanges 34, 36, respectively, of the housing members of the wheel 10, as a result of edge contact made by the tape 30 with these flanges. Additionally, lint from the yarn 14 often gets entangled in the construction of the wheel 10 requiring removal for proper movement of the yarn relative to the wheel. As a consequence of the wearing of the flanges 34, 36, the line entanglement in the wheel, accumulation of wax and spinning oil from the yarn within the wheel, wearing of the pins due to certain types of synthetic yarn being run, rusting of the pins due to non-use or neglect of the equipment and other and similar occurrences, it often becomes necessary for proper functioning of the knitting machine 12 to replace the wheel 10 with another wheel that is capable of performing the feeding function for the yarn 14. Heretofore this was done by replacing the worn out or malfunctioning feed wheel 10 with a new wheel. As an improvement over this practice, it is herein proposed to utilize a special replacement feed wheel, as will now be described specifically in connection with FIGS. 3–7 inclusive.

Figure 3:
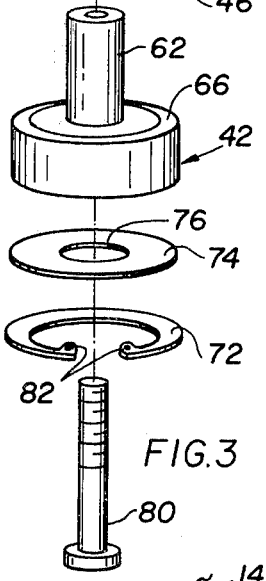
FIG. 3 is an exploded perspective view illustrating the various components of the within improved replacement feed wheel according to the present invention.

The replacement feed wheel of the present invention, generally designated 40, among other advantages includes structural features which permits utilizing as its bearing, the bearing unit 42 which it will be understood is salvaged from the worn-out feed wheel 10. That is, it is contemplated that upon removal of the worn-out feed wheel 10 that the housing units thereof will be separated, and that the bearing unit will be removed so as to be specifically used as part of the replacement feed wheel 40. To this end, and as best illustrated in FIG. 3, the within replacement feed wheel 40 includes a first plastic molded housing member 44 which presents the previously noted flange 36 for proper guiding of the feed tape 30. Cooperating with housing member 44 is a lower or bottom housing member 46, also constructed as a plastic molded article of manufacture, said member 46 presenting the previously referred to lower flange 34 as a guiding surface for the tape 30. Appropriately molded or otherwise provided inwardly of the flanges 34 and 36 is a circumferential arrangement of openings, individually and collectively designated 48. Force fit in the openings 48 is the previously referred to circumferentially spaced pins 20 which function as a support surface for the yarn 14 and tape 30. Preferably the pins 20 are force fit in the openings 48 in a factory assembly procedure which effectively utilizes appropriate jigs and other such devices to facilitate the assembly.

Figure 5:
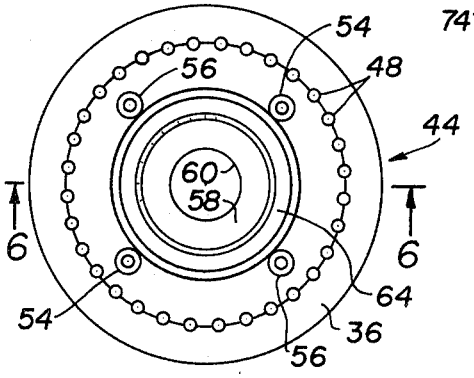
FIG. 5 is a plan view of one of the housing members of the within replacement feed wheel.
Figure 6:
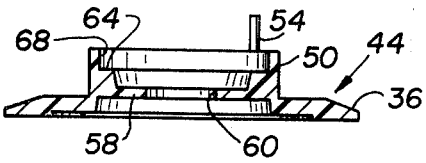
FIG. 6 is a side elevational view, in cross-section taken along lines 6—6 of FIG. 5 illustrating further structural details of the housing members.

As may perhaps best be understood by reference to FIGS. 5, 6 in conjunction with FIG. 3, in a preferred embodiment both the housing members 44 and 46 will be produced as identical molded parts, and whatever structural differences exist between these parts will be provided by a subsequent machining operation, all as will soon be explained. Initially, however, the housing members 44 and 46 are identical, and thus each includes a centrally located cylindrical wall identified as 50 on member 44 and 52 on member 46. In addition to these walls 50, 52, each of the housing members is also provided with two diametrically opposed assembly pins 54 and seats 56 for these pins. Thus, in the factory assembly of the replacement wheel 40, the housing members 44, 46 are arranged in facing relation, as illustrated in FIG. 3, and these housing members are then turned 90° out of phase with each other so that the pins 54 of the one member align with the seats 56 of the other member. Upon the achievement of this, the pins 54 are then force fit in the seats 56 as are the pins 20 in relation to the openings 48.

The molding of the housing members 44 and 46 also produces in each a horizontally oriented wall 58 have a central opening 60 to receive therethrough the mounting shaft 62 of the salvaged bearing unit 42. Wall 58, however, is only retained in the upper housing member 44, and is removed from the other housing member 46 in the preparation of the partially constructed replacement feed wheel 40 so as to achieve the objectives of the present invention.

Figure 7:
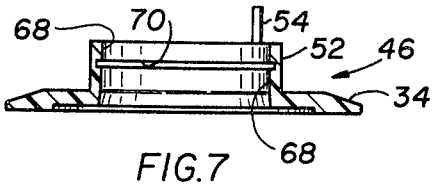
FIG. 7 is a side elevational view similar to FIG. 6, but illustrating the housing member after a machining operation has been performed thereon.

More specifically, as is perhaps best illustrated by progressive examination of FIGS. 6 and 7, the housing unit 44 of FIG. 6 is intended to represent both housing units as they exist immediately following the molding thereof. Thus, both of the housing members, as exemplified by housing member 44 includes the previously noted cylindrical wall 50 and horizontally oriented wall 58. In addition, the central structure 50 is molded with axial openings of different sizes which provide an annular shoulder 64 on which the outer race 66 of the bearing unit 42 seats in the operative position of the bearing unit 42 within the replacement feed wheel 40.

Proceeding now to the modified housing member 46, which modification will be understood to be achieved by machining the same, it will be noted that the machining consists essentially of removal of the shoulder 64 and the wall 58. As a consequence of the removal of the aforesaid structure, the inner surface of the cylindrical wall 52 presents an essentially smooth surface in facing relation to the central rotation axis of the housing member and thus it presents a surface bounding a central bearing-accommodating compartment 68. Machined in surface 68 is a circular groove 70 which receives a C-ring 72 used to hold the salvaged bearing unit 42 in place within the compartment 68, all as will be subsequently explained.

After the molding of the housing members which provides the housing member 44 of FIG. 6 and the machining of one said member into the form designated 46 in FIG. 7, which as just noted provides the bearing compartment 68, the two housing members 44 and 46 are arranged with the flanges 34 and 36 in facing relation with each other. In an appropriate factory assembly procedure the pins 20 are arranged in the circumferentially spaced openings 48 in these housing members and the units are then assembled or interconnected to each other, this assembly being essentially achieved by the male structural features being force fit in the female structural features. This produces the partially complete replacement wheel 40 of the present invention, the same being partially complete because it lacks a bearing which, of course, is necessary in order to enable rotation of the wheel 40. However, as may be readily appreciated from FIG. 3, the lower housing member 46 has a bearing compartment 68 and accordingly bearing member 42 which is salvaged from the worn-out feed wheel is projected into this compartment with the support shaft 62 thereof projected through the opening 60 in wall 58 of the upper member 44. Naturally, the placement of the bearing unit 42 in the compartment 68 is a readily performed manual operation. Next, a preferably plastic washer 74 with a central opening 76 is placed in covering relation against the bottom of the bearing unit 42 to minimize dust contamination thereof. Bearing 42 and the dust seal 74 are then held in place with a C-ring 72 which, under a slight compression, is inserted into the bearing compartment 68 and when aligned with the slot 70 is released and expands radially outward, snapping into place within the slot or groove 70. Completing the construction of the replacement feed wheel 40 and also assisting in the mounting thereof on a support bracket 78 of the knitting machine 12 (see FIG. 2) is a bolt 80 which is projected through the axial openings of the replacement feed wheel 40 and is threadably engaged to the support bracket 78.

From the foregoing it should be readily appreciated that the replacement feed wheel 40 is fully capable of functioning as a rotatable support for the yarn 14 and for the feed tape 30 using a salvaged bearing member 42 from a worn-out feed wheel embodiment and therefore provides, in an obvious manner, the saving of the cost of the bearing which usually is in good working condition even though the plastic feed wheel flanges 34 and 36 may be worn and therefore require replacement of the feed wheel. Additionally, the removability of the bearing means 42, which requires only engaging the C-ring 72 with a pointed pliers, as at the openings 82 and compressing the ring, results in an additional benefit resulting from use of the wheel 40. Specifically, when the wheel becomes entangled with lint, or for any other reason requires cleaning, this can be done using an effective detergent or other washing fluid which ordinarily could not be used without adversely affecting the bearing means 42. However, in accordance with the present invention, it is contemplated that the bearing member 42 will be removed in preparation for the washing or cleaning of the replacement feed wheel 40.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. An improved knitting machine feed wheel for replacing an embodiment thereof worn out from use in feeding yarn from a supply source to a knitting station of said machine, said replacement feed wheel comprising only a partially complete feed wheel construction consisting of a yarn-supporting body operatively arranged in spanning relation between a cooperating pair of first and second housing members, one said housing member having a centrally located cylindrical wall bounding a bearing compartment sized to receive in seated relation therein a bearing salvaged from said worn out feed wheel, said salvaged bearing being operatively disposed within said bearing compartment to complete said construction of said replacement feed wheel, said cylindrical wall having a groove therein extending substantially the entire circular extent thereof and located on the remote side of said bearing in its said seated position within said bearing compartment, and a flexible C-ring disposed in a snap fit in said groove for holding said bearing in place during subsequent yarn feeding service of said wheel.

2. An improved replacement feed wheel for a knitting machine as defined in claim 1 wherein a washer to protect said bearing from dust contamination is interposed between said salvaged bearing and said C-ring.

* * * * *